US005881400A

United States Patent [19]

Arnold

[11] Patent Number: 5,881,400

[45] Date of Patent: Mar. 16, 1999

[54] DEVICE AND METHOD FOR MANIPULATING THE FILL VALVE ASSEMBLY IN A WATER CLOSET

[76] Inventor: Richard C. Arnold, 115 N. Summit Ave., Chatham, N.J. 07928

[21] Appl. No.: 889,619

[22] Filed: Jul. 8, 1997

[51] Int. Cl.[6] ..... E03D 1/00

[52] U.S. Cl. ..... 4/415; 4/353

[58] Field of Search ..... 4/415, 391, 355, 4/356, 412, 661, 353; 137/410, 421, 426

[56] References Cited

U.S. PATENT DOCUMENTS

| | | | |
|---|---|---|---|
| 4,700,413 | 10/1987 | Lopez | 4/415 |
| 5,083,323 | 1/1992 | Cannan | 4/415 |
| 5,232,011 | 8/1993 | Royalty | 4/415 |
| 5,327,931 | 7/1994 | Royalty et al. | 4/415 |

*Primary Examiner*—David J. Walczak

*Attorney, Agent, or Firm*—Gibbons, Del Deo, Dolan, Griffinger & Vecchione

[57] ABSTRACT

A device and method for engaging the fill valve assembly in a water closet and maintaining the fill valve assembly in a closed condition regardless to the level of water in the flush tank of the water closet. The device includes two suspension elements that engage the walls of the flush tank on either side of the float lever portion of the fill valve assembly. A flexible element extends between the two suspension elements, wherein the flexible element passes under the float lever as extends from one suspension element to the other. As the flexible element is pulled taut, the flexible element abuts against the float lever and upwardly biases the float lever. The upward bias that is applied to the float lever causes the fill valve assembly to close. The upward bias also prevents the fill valve assembly from leaving its closed configuration regardless to the level of water in the flush tank.

18 Claims, 3 Drawing Sheets

DEVICE AND METHOD FOR MANIPULATING THE FILL VALVE ASSEMBLY IN A WATER CLOSET

BACKGROUND OF THE INVENTION

1. Field of the Invention

The present invention relates to devices and methods that enable a person to manipulate the position of the fill valve assembly in a water closet, thereby controlling the point at which the fill valve stops filling the flush tank after the water closet has been flushed.

2. Description of the Prior Art

The prior art is replete with different types of water closets and similar sanitary toilets. One of the most common water closet designs available in the prior art uses a flush tank positioned over a bowl. When the bowl needs to be emptied, a flush valve is opened in between the flush tank and the bowl. Water passes into the bowl from the flush tank, thereby washing the contents of the bowl down into the sewer. When the flush tank empties below a predetermined level, the flush valve closes and the flush tank refills with water in preparation for the next flush.

Most modern toilets contain a fill valve assembly that controls the flow of fresh water into the flush tank as the flush tank refills. The fill valve assembly is coupled to an incoming water line. The refill valve is opened and closed by the movement of an elongated lever that has a float at its far end. When the flush tank empties below a predetermined level, the float lays low in the tank and the refill valve is opened, thereby allowing fresh water to flow into the flush tank. As the water level rises, the float also rises until the refill valve closes and the flow of fresh water into the flush tank is stopped.

In many different situations, it is desirable to prevent the flow of water into the water closet through the fill valve assembly. For example, if the bowl of the water closet becomes clogged after the water closet has been flushed, the bowl may overflow onto the floor unless the flow of water into the water closet is immediately stopped. By adding a manual control to the fill valve assembly, the flow of water into the water closet can be stopped before an overflow condition occurs. In addition to the concerns of overflow, another reason for adding a manual control to the operation of the fill valve assembly is that of maintenance. When a water closet is being repaired or cleaned, it is often desirable to empty the water from the flush tank and the bowl. In the past, the water supply to the water closet had to be stopped at a point external of the water closet. This often required a person to remove a plumbing access panel or venture into the service crawl ways of a home in order to access the appropriate water supply valve.

A need therefore exists in the prior art for device and method by which the fill valve assembly of a water closet can be held in a closed set position, regardless to water level within the flush tank, using a device that can be rapidly and easily applied to most all existing water closet designs.

SUMMARY OF THE INVENTION

The present invention is a device and method for engaging the fill valve assembly in a water closet and maintaining the fill valve assembly in a closed condition regardless of the level of water in the flush tank of the water closet. The device includes two suspension elements that engage the walls of the flush tank on either side of the float lever portion of the fill valve assembly. A flexible element extends between the two suspension elements, wherein the flexible element passes under the float lever as it extends from one suspension element to the other. As the flexible element is pulled taut, the flexible element abuts against the float lever and upwardly biases the float lever. The upward bias that is applied to the float lever causes the fill valve assembly to close. The upward bias also prevents the fill valve assembly from leaving its closed configuration regardless of the level of water in the flush tank. As such, a water closet can be effectively turned off for the purposes of cleaning, maintenance or if the bowl of the water closet is in danger of overflowing.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
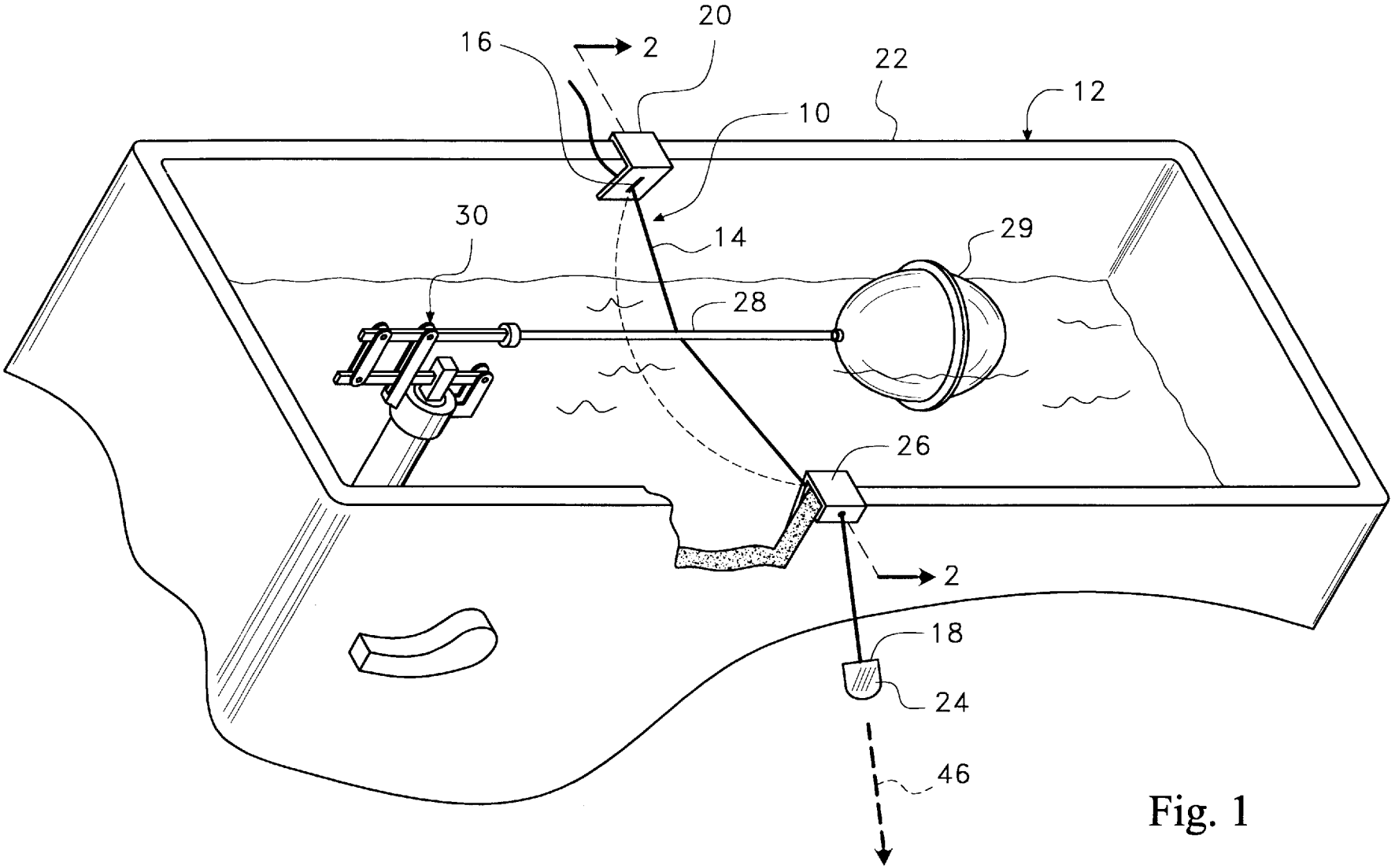
FIG. 1 is a perspective view of an exemplary embodiment of the present invention device shown in conjunction with the top region of an open flush tank from a first type of traditional water closet.

Referring to FIG. 1, there is shown an exemplary embodiment of the present invention device 10 in conjunction with a flush tank 12 of a common domestic water closet. The present invention consists of a flexible element 14 having two opposing ends 16, 18. The first end 16 of the flexible element 14 is anchored to a first suspension element 20 that engages the top edge 22 of the flush tank 12. The second end 18 of the flexible element 14 terminates with an actuator 24, such as a pull tab or similar element that enables a person to easily grasp and pull the flexible element 14. At a point in between the first end 16 and the second end 18 of the flexible element 14, the flexible element 14 passes through a second suspension element 26, wherein the second suspension element 26 engages the top edge 22 of the flush tank 12 at a point approximately opposite that of the first suspension element 20.

Figure 2:
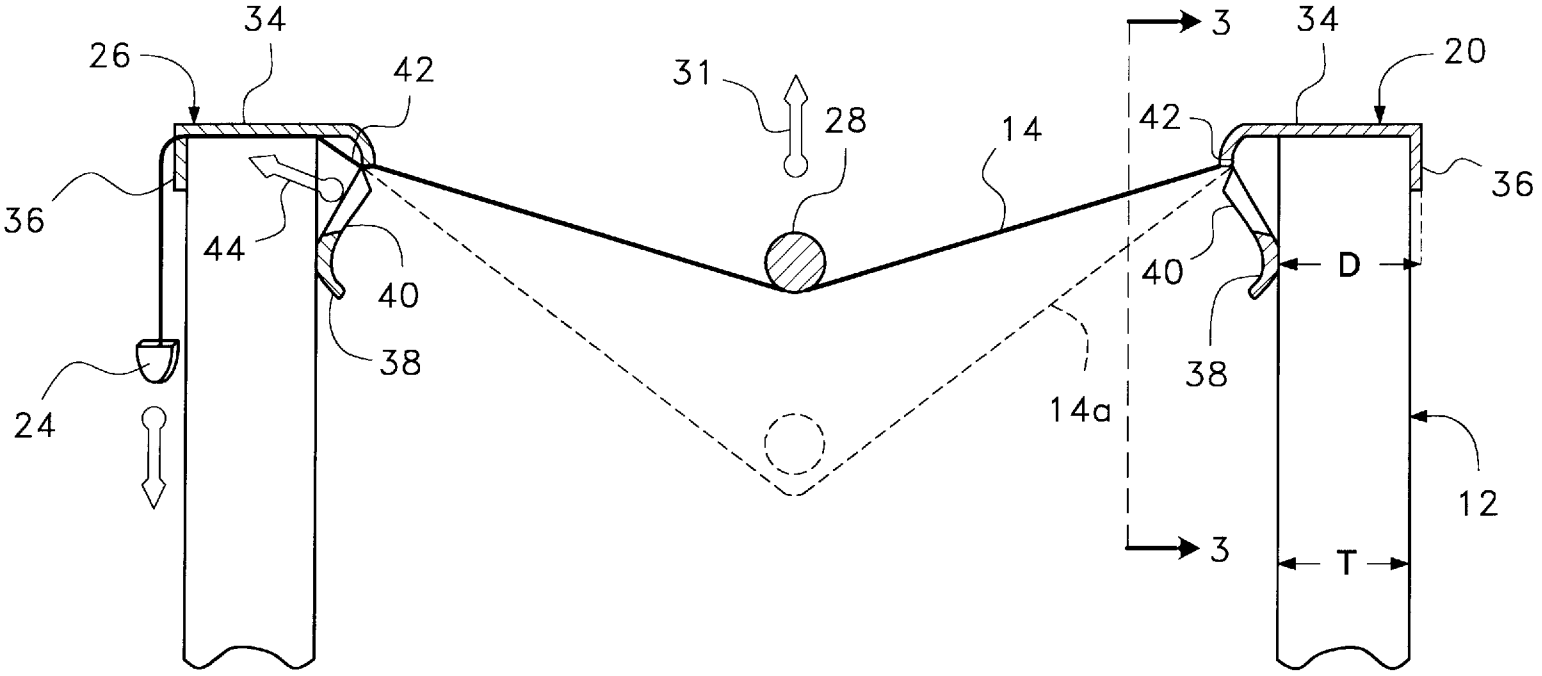
FIG. 2 is a cross-sectional view of the embodiment of FIG. 1, viewed along section line 2—2.

The flexible element 14 extends below the float lever 28 that supports the float 29 in the water closet's fill valve assembly 30. Referring to FIG. 2, it can be seen that when the flexible element 14 is pulled taut by applying a tensile force to the pull tab 24, the flexible element 14 engages the bottom of the float lever 28 in the fill valve assembly and provides an upward bias force to the float lever in the direction of arrow 31. The flexible element 14 is also long enough so as to not engage the float lever 28 when fully slack, as is indicated by the flexible element 14*a* shown in hidden lines.

From FIG. 2, it can be seen that each of the suspension elements 20, 26 has a flat top surface 34. This enables the flush tank lid (not shown) to properly fit on top of the flush tank 12 even when the suspension elements are in place. A short vertical leg 36 extends downwardly from the flat top surface 34 of each of the suspension elements 20, 26. The short vertical legs 36 hook over the exterior walls of the flush tank 12. The short length of the vertical legs 36 enable the vertical legs 36 to be mostly hidden from view by the lid (not shown) of the flush tank 12 when the lid is placed over the top of the flush tank 12.

A spring arm 38 extends downwardly from the opposite end of the flat top surface 34 of each suspension element 20, 26. The initial distance D in between the bottom of each spring arm 38 and each short vertical legs 36 is less than the thickness T of the side wall of the flush tank 12. As a result, when each suspension element 20, 26 is placed onto the wall of the flush tank 12, the spring arm 38 elastically deforms and provides an inwardly acting bias that pinches the wall of the flush tank 12 in between the spring arm 38 and the opposing short vertical arm 36. The pinching action acts as a clamping mechanism that retains the suspension elements 20, 26 firmly in place and prevents the suspension elements 20, 26 from inadvertently moving.

Figure 3:
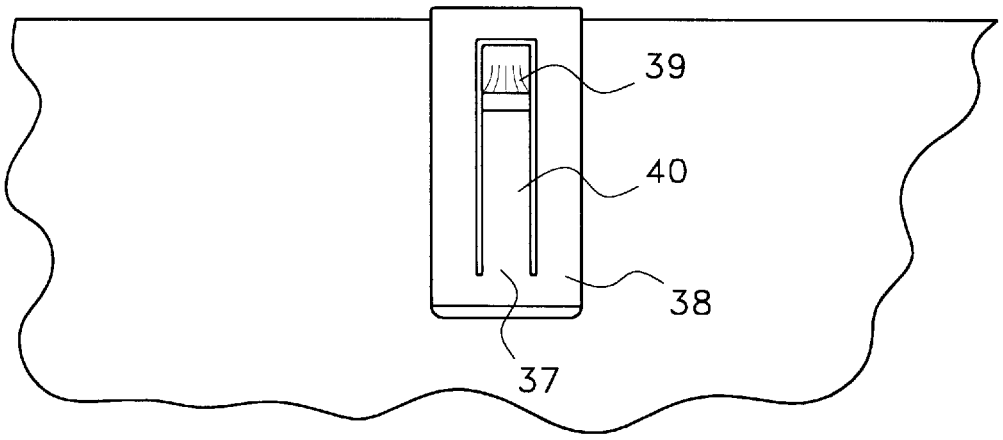
FIG. 3 is a front view of a suspension element viewed along line 3—3 in FIG. 2.

Referring to FIG. 3, it can be seen that a locking pawl 40 or similar structure is disposed near the center of each spring arm 38. The locking pawl 40 has a base 37 that is integrally formed as part of the spring arm 38. The head 39 of the locking pawl 40 is free to flex into and out of the plane of the figure. Returning to FIG. 2, it can be seen that the locking pawl 40 engages the flexible element 14. When the locking pawl 40 is in its undeflected state, a small gap 42 exists in between the top of the locking pawl 40 and the section of the spring arm 38 above the locking pawl 40. The gap 42 is smaller that the thickness of the flexible element 14. As a result, the locking pawl 40 pinches the flexible element 14. In the second suspension element 26, it can be seen that the locking pawl 40 is configured so that when the locking pawl 40 is pushed in the direction of arrow 44, the gap 42 above the locking pawl 40 becomes larger and when the locking pawl 40 is pushed in a direction opposite arrow 44, then the gap 42 above the locking pawl 40 becomes smaller. As the flexible element 14 passes through the second suspension element 26, the presence of the flexible element 14 holds the locking pawl 40 in a slightly open position. As the flexible element 14 is pulled in the direction of arrow 44, the locking pawl 40 opens wider and the flexible element 14 is free to move through the second suspension element 26. However, if a force is applied to the flexible element 14 in a direction opposite arrow 44, then the gap 42 above the locking pawl 40 becomes smaller and the flexible element 14 binds and is prevented from moving in that direction. If a person does desire to move the flexible element 14 in the direction opposite of arrow 44, then the locking pawl 40 must be manually pressed in the direction of arrow 44 while the flexible element 14 is pulled in the direction opposite arrow 44.

Returning to FIG. 1, it can be seen that as the actuator 24 at the second end 18 of the flexible element 14 is pulled in the direction of arrow 46, the flexible element 14 moves through the second suspension element 26 and provides an upward bias to the float lever 28 of the fill valve assembly 30. The upward bias ensures that the float lever is at a point where the flow of water is stopped. As such, the refill valve of the fill valve assembly 30 is held in a closed position. If the water closet leaks or otherwise drains, the float lever will not descend. As such, the water closet will not repeatedly refill. A person can then clean the water closet, repair the water closet, provide overflow protection or otherwise leave the water closet for long periods of time without concern about the water closet wasting water in refilling itself unnecessarily. When the water closet is again ready to be used, the locking pawl 40 (FIG. 2) in the second suspension element 26 is opened and the flexible element 14 is given enough slack to enable the water closet to operate normally.

Figure 4:
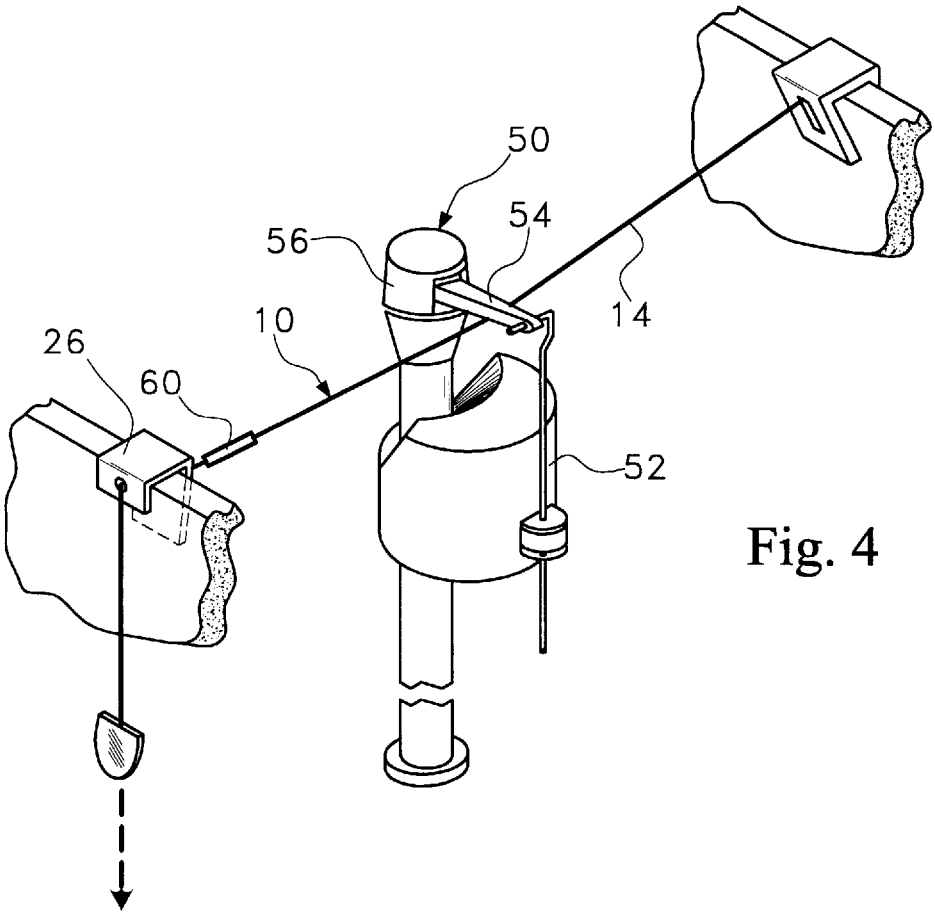
FIG. 4 is a perspective view of an exemplary embodiment of the present invention device shown in conjunction with the top region of an open flush tank from a second traditional type of water closet.

Referring to FIG. 4, there is shown an alternate type of prior art fill valve assembly 50. In the fill valve assembly 50 shown, the float 52 is suspended from a short lever arm 54 that controls a refill valve 56. When the lever arm 54 is pushed up by the float 52, the refill valve 56 is closed. Conversely, when the lever arm 54 is pulled down by the float 52, the refill valve 56 opens. The present invention device 10 can also be used on such a prior art fill valve assembly 50. By passing the flexible element 14 under the lever arm 54, the flexible element 14 can be used to bias the lever arm 54 in an upward closed condition by pulling the flexible element 14 taut in the manner previous described in regard to FIG. 2.

In the exemplary embodiment of FIG. 4, an optional stop element 60 is also shown. The stop element 60 can be selectively attached to the flexible element 14 at any point. The stop element 60 can not pass through the second suspension element 26. As such, when the stop element 60 abuts against the second suspension element, no further tensile force can be applied to the flexible element 14 in between the first suspension element and the second suspension element. This prevents the lever arm 54 from experiencing a corresponding upward bias that may bend or otherwise damage the lever arm 54.

It will be understood that the configuration of the suspension elements described are merely exemplary and many other types of clamp configurations and bracket configurations can be used. The purpose of the suspension elements is to engage the sides of the flush tank and support the flexible element in a suspended condition in between two opposing walls of the flush tank. The suspension elements engage the flexible element in such a way so that the flexible element can be easily made more taut by pulling the free end of the flexible element. The suspension elements prevent the flexible element from inadvertently becoming less taut once the flexible element is pulled taut. There are many string engagement mechanisms and one-way fasteners that perform similar functions. Any such mechanism capable of performing these functions can be used in place of the suspension elements that were specifically described.

It will be understood that the embodiment of the present invention specifically shown and described is merely exemplary and that a person skilled in the art can make alternate embodiments using different configurations and functionally equivalent components. All such alternate embodiments are intended to be included in the scope of this invention as set forth in the following claims.

What is claimed is:

1. In a water closet flush tank having a first wall, a second wall, and a fill valve assembly disposed between the first wall and the second wall, wherein the fill valve assembly contains a float suspended by a lever, a device for maintaining the fill valve assembly in a closed condition, comprising:

a flexible element having a first end and an opposing second end;

a first suspension element adapted to engage the first wall of said flush tank on a first side of the lever, wherein said first end of said flexible element terminates at said first suspension element; and a second suspension element, remote from said first suspension element, that is adapted to engage the second wall of said flush tank on a side of the lever opposite said first side, wherein said flexible element passes under the lever and through said second suspension element to a point external of said flush tank.

2. The device according to claim 1, wherein said flexible element experiences a predetermined tensile force in between said first suspension element and said second suspension element when a corresponding tensile force is applied to said second end of said flexible element, and said second suspension element contains a mechanism for maintaining said predetermined tensile force in between said first suspension element and said second suspension element after said corresponding tensile force is removed from said second end of said flexible element.

3. The device according to claim 2, wherein said flexible element biases the lever upwardly when said predetermined tensile force is applied to said flexible element.

4. The device according to claim 2, wherein said mechanism includes a release for selectively disengaging said flexible element and enabling said flexible element to become slack in between said first suspension element and said second suspension element.

5. The device according to claim 1, further including an actuator coupled to said second end of said flexible element.

6. The device according to claim 1, wherein said first suspension element is adapted to mechanically engage the first wall of the flush tank.

7. The device according to claim 1, wherein said second suspension element includes a clamp for mechanically engaging the first wall of the flush tank.

8. The device according to claim 1, further including a stop element affixed to said flexible element at a point in between said first suspension element and said second suspension element, wherein said stop element can not pass through said second suspension element.

9. The device according to claim 8, wherein said stop element is adjustable in position relative to said flexible element.

10. A device comprising:

a first suspension element adapted to engage the top of a wall;

a flexible element having a first end and an opposite second end, wherein said first end terminates at said first suspension element;

a second suspension element remote from said first suspension element and adapted to engage the top of a wall, wherein said flexible element passes through said second suspension element and said second suspension element is positioned along said flexible element at a point in between said second end of said flexible element and said first suspension element.

11. The device according to claim 10, wherein said second suspension element includes a locking element that enables said flexible element to pass through said second suspension element in a first direction and inhibits passage of said flexible element in an opposite second direction.

12. The device according to claim 11, wherein said locking element includes a release for selectively enabling said flexible element to pass through said second suspension element in said second direction.

13. The device according to claim 10, further including a pull tab affixed to said second end of said flexible element.

14. The device according to claim 10, further including a stop element affixed to said flexible element at a point in between said first suspension element and said second suspension element, wherein said stop element can not pass through said second suspension element.

15. The device according to claim 14, wherein said stop element is adjustable in position relative to said flexible element.

16. A method of securing the float lever of a water closet fill valve assembly in a closed position, wherein the fill valve assembly is disposed between a first wall and a second wall of a water closet flush tank, said method comprising the steps of:

suspending a flexible element between opposing points on said first wall and said second wall, wherein said opposing points are at a height above the float lever and wherein said flexible element passes under the float lever while suspended between said opposing points; and applying a tensile force to said flexible element causing said flexible element to become taut and apply an upward bias to said float lever.

17. The method according to claim 16, wherein said step of applying a tensile force includes pulling on said flexible element with said tensile force.

18. The method according to claim 16, wherein an actuator is coupled to said flexible element and said step of applying a tensile force includes pulling on said actuator.

* * * * *